United States Patent [19]

Roberg

[11] Patent Number: 4,629,070

[45] Date of Patent: Dec. 16, 1986

[54] HOLDER FOR PHOTOGRAPHIC FILM STRIPS

[76] Inventor: Paul J. Roberg, 51 Surrey La., Tenafly, N.J. 07670

[21] Appl. No.: 727,870

[22] Filed: Apr. 26, 1985

[51] Int. Cl.[4] ..... B65D 85/48

[52] U.S. Cl. ..... 206/455; 206/232; 206/488; 206/489; 229/72; 383/38; 383/39

[58] Field of Search ..... 206/38, 449, 455, 456, 206/472, 473, 488, 489, 216, 232; 383/38, 39, 41; 229/71, 72

[56] References Cited

U.S. PATENT DOCUMENTS

| | | | |
|---|---|---|---|
| 1,877,910 | 9/1932 | L'enfant | 206/38.1 |
| 2,154,510 | 4/1939 | King et al. | 383/38 |
| 3,749,237 | 7/1973 | Dorton | 383/39 |
| 3,979,051 | 9/1976 | Close | 206/455 |
| 4,170,081 | 10/1979 | Kiejzik | 206/455 |
| 4,223,043 | 9/1980 | Johnson | 383/38 |
| 4,274,537 | 6/1981 | Cooper | 206/472 |
| 4,361,231 | 11/1982 | Patience | 383/39 |
| 4,436,202 | 3/1984 | Berkley | 206/455 |

FOREIGN PATENT DOCUMENTS

| | | | |
|---|---|---|---|
| 1155016 | 9/1963 | Fed. Rep. of Germany | 206/455 |
| 2201381 | 7/1973 | Fed. Rep. of Germany | 206/455 |
| 1492571 | 11/1977 | United Kingdom | 206/455 |

*Primary Examiner*—Joseph Man-Fu Moy
*Assistant Examiner*—David T. Fidei
*Attorney, Agent, or Firm*—Stefan J. Klauber

[57] ABSTRACT

Transparent plastic film holders are provided containing one or a plurality of pockets for photographic items such as strips of photographic film, negatives, prints or individual frames thereof which are formed by attaching two plies of transparent films by spaced bonding lines between said plies of films to define rectangular retaining pockets, said retaining pockets having two opposite closed ends and an extended openable end between two closed ends for insertion of a film item into the pocket, said openable end being closed off for a short distance from the opposite closed ends of the pocket by bonding the plies of film and forming a restraining lip extending from the opposite closed ends whereby the inadvertent dislodging of a photographic item from within the pocket is prevented.

16 Claims, 6 Drawing Figures

HOLDER FOR PHOTOGRAPHIC FILM STRIPS

FIELD OF THE INVENTION

This invention relates to holders for photographic film and prints and, more particularly, to improved transparent holders for strips of photographic negatives, microfiche film and the like, wherein the photographic articles can be readily inserted for storage, viewing and/or transporting and will be restrained from being inadvertently dislodged from the holders.

BACKGROUND OF THE INVENTION

Transparent jackets for strips and individual photographic negatives, film, prints, slides and the like, such as disclosed in U.S. Pat. Nos. 3,546,053, and 3,866,648, are in wide use in industry and for a variety of commercial and consumer applications. Such jackets are generally formed of a pair of transparent plastic films which have a plurality of spaced apart parallel and/or perpendicular bonding lines between the pair of films to form film pockets therein of suitable dimension for insertion of the photographic materials.

Such jackets are stored in files or books and carry the photographic negatives, film or prints for scanning or copying and enlarging by photographic or other processes. The pockets of the jackets may be loaded from time to time with strips or individual frames of film, prints, slides or the like and then stored until they are later required.

Various versions of jackets are available which are commonly of a size that can be fitted as pages into books, such as ring binders or hang in file drawers. One such type is characterized as including a series of parallel pockets, which can extend along the short or long dimensions of said pages. Such pockets may include a long lateral opening across the top ("top-loading"), or a small cross-cut at one or both ends, wherein strips of predetermined lengths can be loaded into the pockets from the top, or by inserting and sliding in from either end.

While "top-loading" pockets makes possible the ready insertion or removal of film strips with less likelihood of damaging them as compared to inserting an end thereof and then loading by sliding, the easy accessability of the strips makes them more susceptible to being inadvertently dislodged when, for example, the pages filed in a book are removed, or when the books are moved or used. It has been surprisingly found that if the length of the lateral opening across a top edge of the "top loading" pocket can be shortened somewhat, the inadvertent dislodging of a photographic film strip or an individual frame thereof from the pocket can be substantially eliminated without significantly reducing the ease of insertion or removal thereof. This can be achieved by bonding the edges of the pair of transparent films forming the holder or jacket for a short distance at one or both ends of the opening along the open end of the pocket.

An object of the present invention is to provide a transparent plastic film holder or jacket having at least one retaining pocket, said retaining pocket having two opposing closed ends and an openable end extending between said closed ends along a substantial portion of an edge of said pocket with opposing plies of the plastic film defining said openable end being closed for a short distance, at one or both ends thereof, which substantially reduces or eliminates inadvertent dislodging of strips of photographic film from within the pocket.

Another object of the present invention is to provide a transparent film holder having a plurality of retaining pockets, each of said retaining pockets having an openable end extending between two opposite closed ends, wherein the openable end of said pocket is closed for a short distance at one or both ends thereof extending from said opposed closed ends to eliminate inadvertent disloding of strips of photographic film from within the pocket.

Yet another object of the present invention is to provide a holder for photographic film strips having a plurality of retaining pockets for said strips of photographic film, each of said pockets having an openable end between two opposite closed ends wherein the length of said pocket and said openable end are substantially the length of a strip of photographic film to be inserted therein and said openable end is closed for a short distance at one or both ends thereof extending from the opposed closed ends of the pocket to prevent the inadvertent dislodgement of film strips from within the retaining pockets.

Still another object of the present invention is to provide a transparent film holder for photographic film negatives, prints or the like, having at least one retaining pocket, said retaining pocket having an openable end intermediate two opposite closed ends, wherein said openable end has one or both ends thereof closed for a short distance, and a closed end of said pocket opposite the openable end being openable for a short distance and whereby inadvertent dislodging of photographic films or the like stored within the pocket is reduced or eliminated and insertion or removal of photographic films or the like can be accomplished without undue distortion or sliding of the photographic article.

Another object of the present invention is to provide a transparent film holder for a plurality of strips of photographic film, or individual frames thereof which can be fitted as pages in books, hang in file drawers or the like, wherein the photographic items can be readily inserted into or removed from said holder without undue distortion or sliding thereof while the inadvertent dislodging of the photographic items is reduced or substantially eliminated when the holder is stored, used and/or moved.

Other objects, features and advantages of the present invention will become apparent from the following specification and claims, together with the accompanying drawings.

SUMMARY OF THE INVENTION

In accordance with the present invention, there is provided a transparent jacket or holder for photographic items such as photographic films, negatives, and prints comprising a pair of transparent plastic films, one overlying the other, said films being attached to one another by spaced bonding lines between said film to define at least one generally rectangular retaining pocket, said retaining pocket having two opposite closed ends and an openable end intermediate said opposite closed ends for insertion of a photographic item into said pocket; said openable end being provided by an edge of at least one of said plies of film being unattached and with the plies of film defining said openable end being bonded together for a short distance extending from one or both opposing closed ends of said pocket to form a restraining lip at said openable end whereby inadvertent dislodging of a photographic item from within the pocket will be prevented.

It has been found that the transparent holder or jacket articles of the present invention having a "top-loading" pocket by virtue of the openable end of the pocket extending along the top or a major length of the pocket, surprisingly and unexpectedly provides for the ready insertion and removal advantages of the conventional "top-loading" film holder while reducing or substantially eliminating the possibility of a strip of photographic film being inadvertently dislodged from within the pocket during storage, use, and/or handling of the film holder. The "top-loading" film holder of the invention can contain one, or a plurality of pockets for holding of film strips, or individual frames, including slides and/or prints, and is suitable for storing in ring-binder books, hanging files and the like.

In a preferred embodiment of the invention which further aids in the insertion or removal of a long length of film strip or of certain single frame photographic items, there will be included in the closed end of the pocket opposite the openable end, a slit opening or openings extending for a short distance from one or both ends of the opposite closed ends of the pocket. The slit opening or openings in the closed end of the pocket opposite the openable end which are, generally, in alignment with a restraining lip in the openable end, facilitates manipulation of a photographic film strip inserted into the pocket during loading and removal thereof.

DESCRIPTION OF PREFERRED EMBODIMENTS

Figure 1:
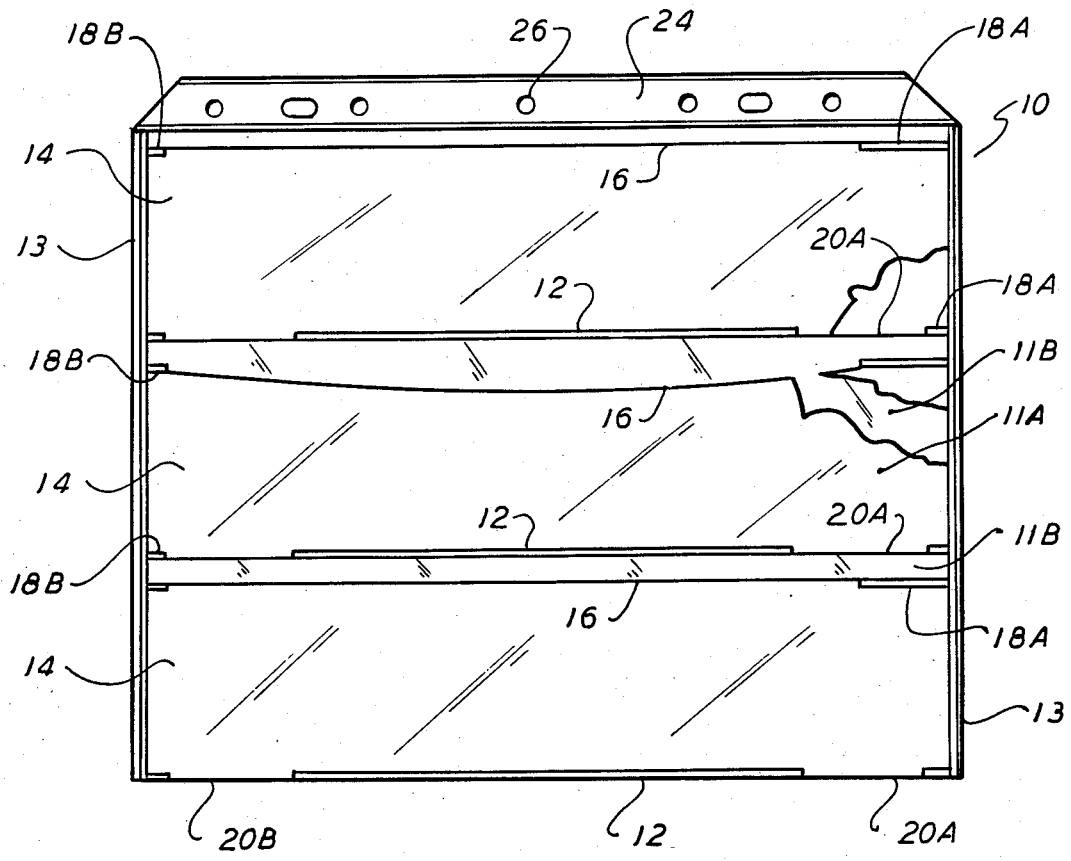
FIG. 1 is a plan view of the holder for photographic film in accordance with the present invention.

Referring now to the drawings, wherein like reference numerals denote like parts, there is shown in FIG. 1 a holder for photographic film 10 constructed in accordance with the present invention, which is formed from two layers, plies or sheets 11A, 11B of transparent plastic film. Any tough, transparent plastic film, such as polyethylene, polyvinylchloride, polyester, triacetate and, preferably, polypropylene, would be suitable for use in preparing such holders. The sheets or plies of plastic film are bonded or sealed together along a series of parallel spaced sealing lines 12 and perpendicular spaced sealing lines 13 to define rectangular receiving or retaining pockets 14 between the sealing lines 12, 13. The pockets, in general, have a dimension somewhat greater than the height and length of a photographic film strip which is designed to be inserted into the pockets.

An open end or slit 16 where the plies of film 11A and 11B are unattached to each other extends across the top of each of said pockets 14 for substantially the entire length thereof, so that a strip of photographic film may be readily inserted into the pocket 14. A narrow portion of each end of the top edge of each of said pockets is bonded or sealed for a short distance, by sealing line 18A and 18B, extending inwardly from side sealing lines 13, so that the slits or openings 16 are somewhat shorter in length, than the length of the pockets 14. Such bonding lines 18A and 18B provide restraining lips extending inwardly from the oppositely formed closed ends 13 of said pockets 14. Slits or slot opening 20A and 20B are formed in the generally closed bottom end 12 of the pockets 14 opposite the open end 16, these slits 20A and 20B being in general vertical alignment with bonding lines 18A and 18B.

Restraining lips formed by sealing lines 18A and 18B in the open ends 16 of the pockets 14, may extend inwardly from one or the other of the closed ends 13 or preferably, for at least a short length from each of the closed ends 13 of the pocket 14. The length of each of the restraining lips 18A and 18B, can be the same or different and will in general, range in size depending on the size of the film item to be retained in the pocket. As indicated, the length thereof can be quite short, e.g. 3 mm, but will usually be somewhat longer. Preferably, at least about a 5 mm long restraining lip will be formed at each of the ends of the pocket and the combined length of the restraining lips 18A and 18B will generally be sufficient to reduce the length of the opening 16 in the top of the pocket 14 from about the length of a photographic item such as a film strip to about 90% of the length of a film strip to be inserted therein.

The sealing lines 12, 13 and 18A and 18B are preferably formed by heat, RF ultra sound or the like sealing so that the two films 11A and 11B are fused together at their point of contact with sufficient strength to define the retaining pockets 14. Other means of forming the bonding lines, such as gluing the films together, may also be employed in preparing the holders of the invention.

The holder for photographic film 10 is of a size that can be fitted into a book, such as a ring binder, or suspension file for storage, carrying and/or use. To accommodate such use, a reinforcement strip 24 of paper, plastic or the like may be bonded across the top edge of the holder for the punch holes 26, which enable insertion in a ring binder and/or a slot for insertion of a support bar for hanging files.

Figure 2:
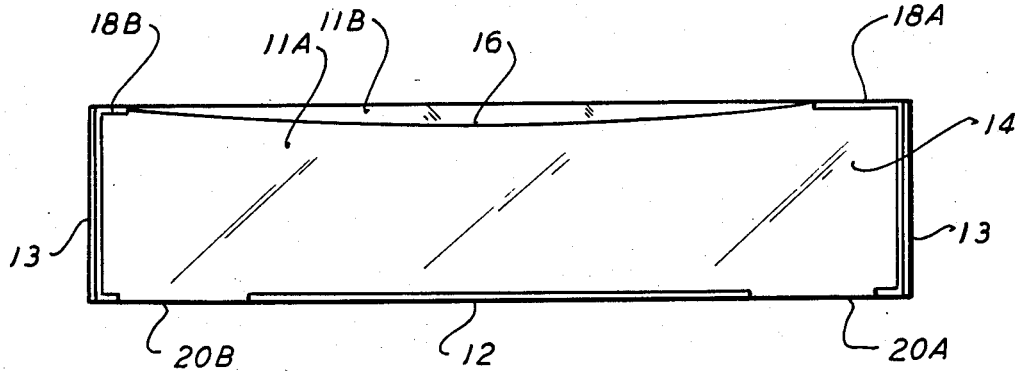
FIG. 2 is a plan view of an alternate embodiment of the holder for photographic film in accordance with the present invention.

Referring now to FIG. 2, there is shown in modification or alternate construction of the holder of the invention which consists of the sheets of plastic 11A, 11B being bonded to form a holder 10 having a retaining pocket 14, defined by the bottom sealing line 12, the side sealing lines 13, and the restraining lip seal lines 18A and 18B which reduce somewhat the length of the open top end 16 of the pocket 14. The slits 20A and 20B in the bottom sealing line 12, are preferably, in general alignment with the ends of restraining lip seal lines 18A and 18B.

Figure 6:
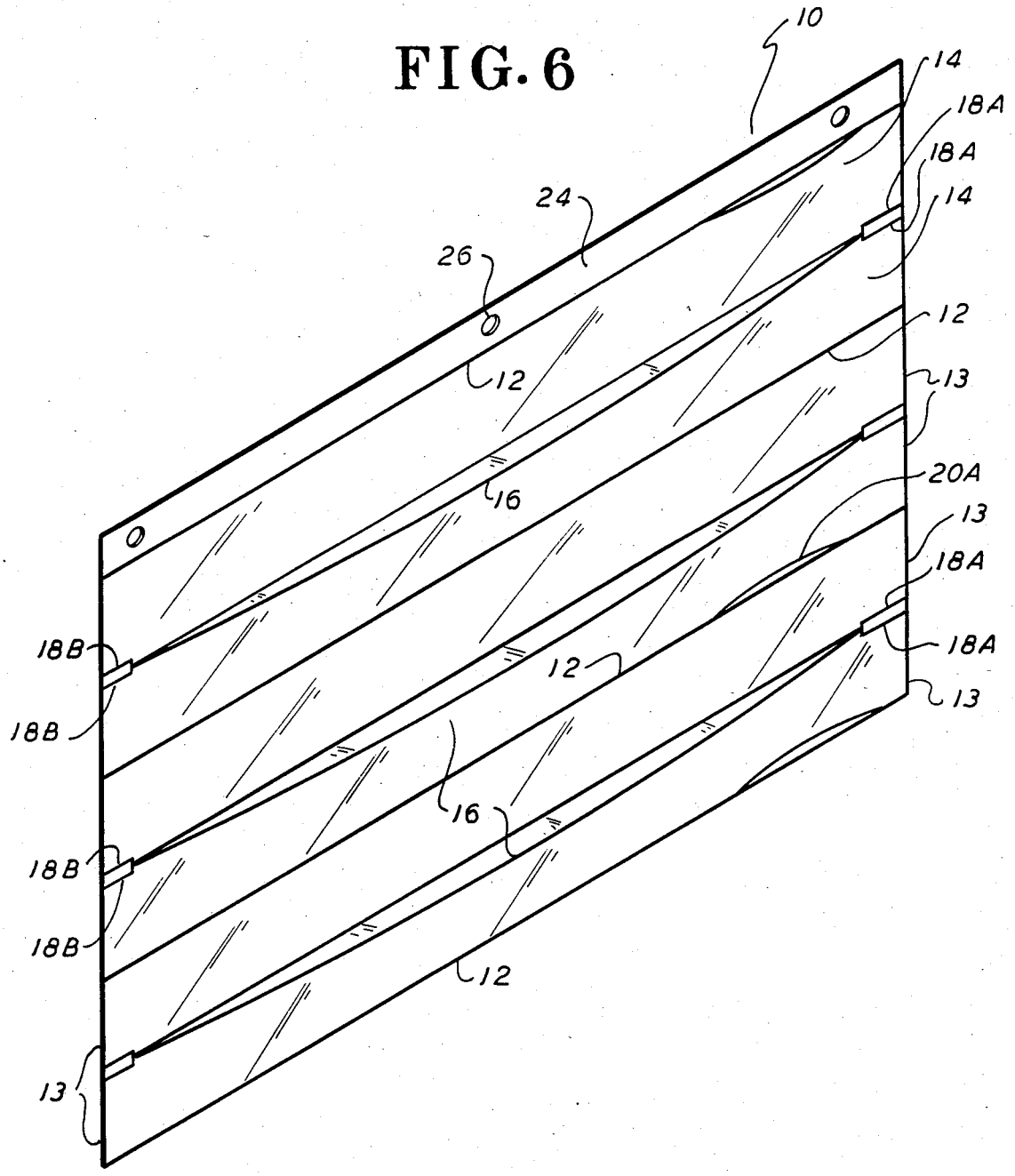
FIG. 6 is a perspective view of an alternate embodiment of a holder for photographic film in accordance with the present invention.

In FIG. 6 is shown a further possible modification or alternate construction of a holder 10 having a plurality of parallel retaining pockets 14 for strips of photographic film. The pockets are defined by a series of parallel closed bottom ends 12 and perpendicular end sealing lines 13. The closed bottom ends 12 of said pockets may be formed by folding a sheet of plastic film so that one ply thereof overlies the other or by heat sealing two separate sheets of plastic film. An open end or slot 16 for each of the pockets 14 is provided intermediate the bottom closed ends 12 for each of the pockets. Restraining lips seal lines 18A and 18B are formed in each end of the slot or open end 16 of the pockets 14. The embodiment shown also has a reinforcement strip 24 across the top end of the holder 10 and punch holes 26 for mounting the holder 10 in a ring binder.

Figure 3:
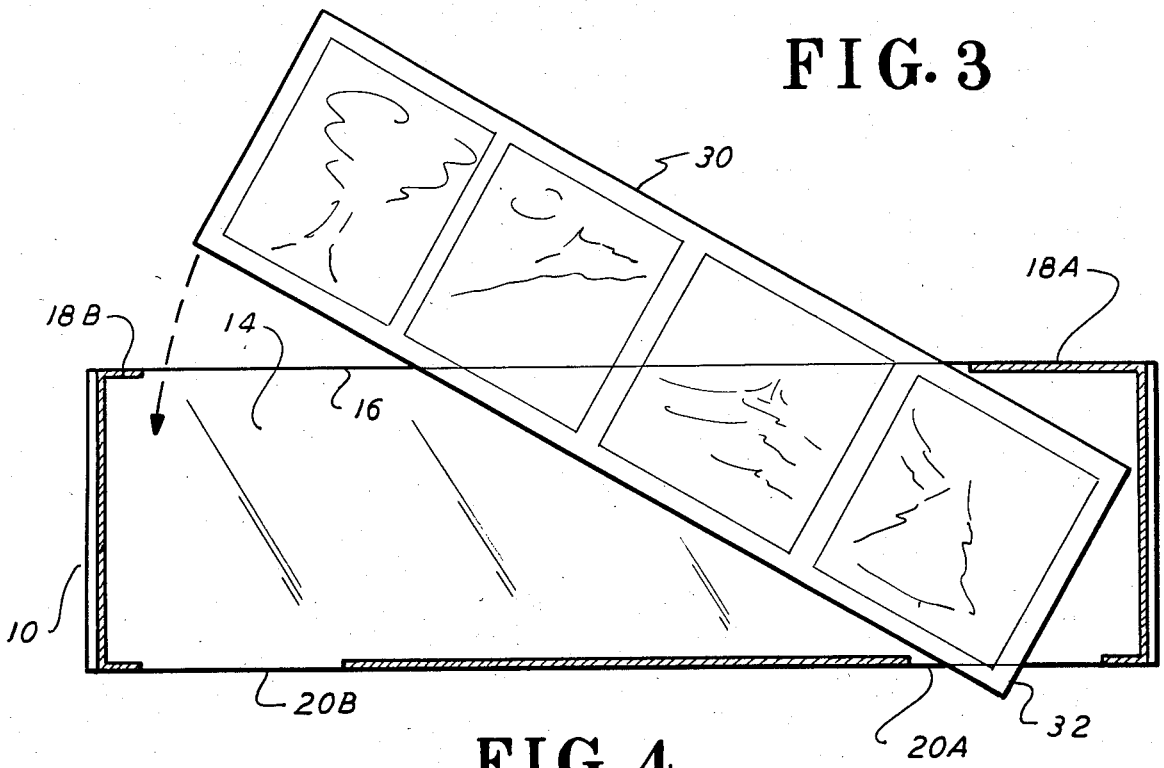
FIG. 3 is a plan view of the holder shown in FIG. 2, with a strip of photographic film partially inserted into a pocket in the holder.
Figure 4:
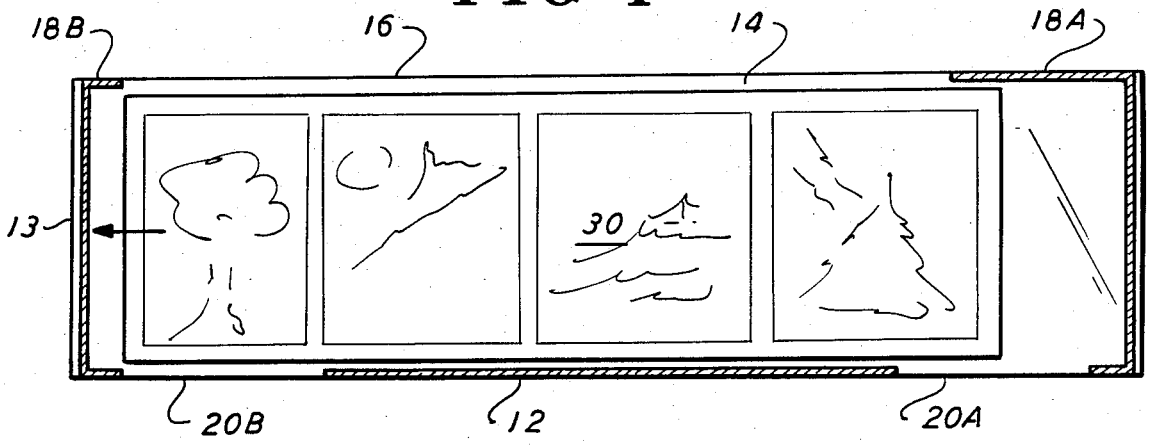
FIG. 4 is a plan view of the holder shown in FIG. 2 with a strip of photographic film inserted into a pocket in the holder.
Figure 5:
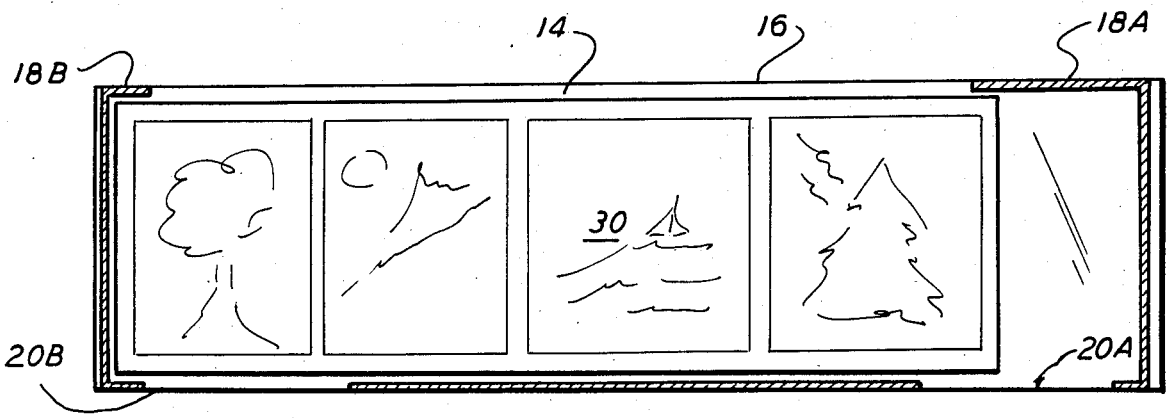
FIG. 5 is a plan view of the holder shown in FIG. 2 with a strip of photographic film inserted into a pocket in the holder in interlock positon therein.

In actual use, a simple procedure serves to insert a strip of photographic film in a holder of the invention, and provide for the ready removal thereof when desired. As shown in FIGS. 3, 4 and 5, a strip of film 30 is inserted at an angle into the pocket 14 of a holder 10 through openable end 16. The corner 32 of film strip 30 is inserted into a slot 20A in the bottom seal line 12, thus providing sufficient space in the openable end 16 for insertion of film strip 30 past restraining lip 18B, as shown in FIG. 4. Film strip 30 should then be slid to the left (FIG. 5) so that the end of the film strip 30 within the pocket 14 is locked in by restraining lip 18B as well as by restraining lip 18A. Thus, restraining lips 18A and 18B prevent dislodging of the film strip 30 from within pocket 14 during the storage, use, or moving thereof.

While the present invention has been particularly described in terms of specific embodiments thereof, it will be understood in view of the instant disclosure, that numerous variations upon the invention are now enabled to those skilled in the art, which variation yet resides in the scope of the present teaching. Accordingly, the invention is to be broadly construed, and limited only by the scope and spirit of the claims now appended hereto.

What is claimed is:

1. A transparent holder for rectangularly elongated photographic items such as film strips, negatives and prints, comprising: two plies of transparent plastic films, one overlying the other and being attached to one another by peripheral bonding lines between said plies to define at least one rectangular retaining pocket having a first long dimension and a second short dimension for receipt of a photographic item of generally similar dimensions; said retaining pocket having two opposite closed ends extending along said short dimensions; a generally open accessible side extending along the long dimension, and a generally closed side opposite said open side; said open side being defined by an edge of at least one of said plies of film being unattached to the opposed plie at the central part of the long dimension, to thereby define a central opening, but with the plies of film defining said open side being attached together by a bond line extending from the end of the central opening for a short distance to the adjacent short closed end of said pocket, to thereby form a restraining lip at said one end of the open side of said pocket, whereby said photographic item can be readily inserted through the accessible open side into said pocket and the end of said item slidingly received beneath said restraining lip to prevent the inadvertent dislodging of said photographic item from within said restraining pocket.

2. A transparent holder according to claim 1, wherein said bonding lines define a plurality of said rectangular retaining pockets for photographic items of generally similar dimensions, each of said pockets having a said open side for insertion of a photographic item into said pocket and a restraining lip to prevent inadvertent dislodging of a photographic item from within said retaining pocket through said openable end.

3. A transparent holder according to claim 1 wherein said bonding lines define one rectangular retaining pocket and said open side is defined by opposing unattached edges of each of said plies of film.

4. A transparent holder according to claim 1 wherein said generally closed side opposite said open side includes a slit opening intermediate said short opposite closed ends of said pocket, to facilitate manipulation of said photographic item during insertion into said pocket, by permitting a corner of said item to protrude intermittently through said slot during the manipulation.

5. A transparent holder according to claim 1 including a pair of restraining lips, one each being formed at each end of said generally open side of said pocket, and wherein said generally closed side opposite said open side includes a pair of slit openings each slit of which is generally in alignment with a said restraining lip.

6. A transparent holder according to claim 1 wherein said retaining pocket is an elongated pocket generally of dimensions to receive a strip of photographic film and with the central opening at the generally open side of said retaining pocket having a length suitable for insertion of the full length of a strip of photographic film without damage thereto and without sliding.

7. A transparent holder according to claim 2, wherein said retaining pockets are a plurality of elongated side-by-side pockets extending generally the dimensions of said plies to define a page of said pockets to receive strips of photographic film, and with the central openings at said open sides of said retaining pockets having a length suitable for insertion of the full length of a strip of photographic film without damage thereto and without sliding.

8. A transparent holder according to claim 2 including means for holding said holder in a ring-binder book.

9. A transparent holder according to claim 2 including means for hanging said holder in a hanging file.

10. A transparent holder according to claim 1 wherein the central opening at the open side of said pocket is about 90% of the length of a photographic item to be inserted in the pocket.

11. A rectangular plastic film holder for photographic items such as strips of film, negative and prints, comprising a first sheet of plastic film and at least one second sheet of plastic film overlying said first sheet and attached thereto by peripheral bonding lines at the respective bottom and lateral edges of said second sheet to define a generally enclosed pocket, having a generally open first longitudinal side, an opposed generally closed second longitudinal side, and two opposed closed transverse sides; said generally open longitudinal side being defined by a top edge of said second sheet being bonded to said first sheet for a short portion of the first longitudinal side thereof which extends from at least one of the transverse sides of said pocket, and by a substantial portion of said second sheet extending along said longitudinal side from said bonded short portion being unattached to said first sheet to define a central opening for insertion of said strip of film into said pocket whereby the said short attached portion forms a restraining lip which can overlie a photographic item emplaced in said pocket through said central opening, to prevent accidental dislodgement of same from said pocket.

12. The plastic film holder according to claim 11 wherein a plurality of said second sheets are attached to said first sheet to define a plurality of generally enclosed pockets.

13. The plastic film holder according to claim 11 wherein the longitudinal sides of said pocket are substantially longer than the transverse sides.

14. The plastic film holder according to claim 13 wherein a portion of the bottom edges of said second sheets are unattached to said first sheet to provide an opening therebetween in said generally closed longitudinal side to facilitate manipulation of said photographic item during insertion into said pocket by permitting a corner of said item to intermittently protrude through said opening during the manipulation.

15. The plastic film holder according to claim 14, including means for holding said holder in a ring-binder book.

16. The plastic film holder according to claim 12 wherein at least said second sheets of plastic film are transparent.

* * * * *